United States Patent [19]

Taylor

[11] 3,980,016

[45] Sept. 14, 1976

[54] PRESSING APPARATUS

[75] Inventor: Thomas Taylor, Poulton-le-Fylde, England

[73] Assignee: Imperial Chemical Industries Limited, London, England

[22] Filed: Aug. 19, 1975

[21] Appl. No.: 605,884

[30] Foreign Application Priority Data

June 18, 1975 United Kingdom .....25952/75

[52] U.S. Cl. ..... 100/295; 100/93 P; 156/288; 156/583; 425/406; 267/162

[51] Int. Cl.[2]..... B30B 15/06; B30B 15/34

[58] Field of Search..... 100/295, 93 P; 425/406; 156/288, 583; 267/161, 162

[56] References Cited

UNITED STATES PATENTS

| | | | |
|---|---|---|---|
| 2,874,751 | 2/1959 | Norton | 100/93 P |
| 3,434,910 | 3/1969 | Kannegiesser et al. | 100/93 P X |
| 3,619,310 | 11/1971 | Clarke | 156/145 |
| 3,682,466 | 8/1972 | Huchette et al. | 267/161 |

FOREIGN PATENTS OR APPLICATIONS

| | | | |
|---|---|---|---|
| 1,242,234 | 8/1960 | France | 267/162 |
| 666,758 | 2/1952 | United Kingdom | 156/288 |
| 708,070 | 4/1954 | United Kingdom | 100/93 P |

*Primary Examiner*—Peter Feldman
*Attorney, Agent, or Firm*—Cushman, Darby & Cushman

[57] ABSTRACT

Pressing apparatus wherein a cell containing a workpiece is subjected to pressure in a press in which at least one resilient layer of disc-spring units is used as a pressure distributing medium comprises a press, two press plates and a pressure distributor disposed between the pair of plates and one of the press platens. The pressure distributor consists of a plurality of disc-spring units disposed adjacent to one another over the surface of a supporting plate. Each disc-spring unit comprises a pair of disc-springs disposed one on either side of the supporting plate with the apexes of the springs towards each other, the springs of each pair being fastened together by means of rivets passing through an orifice in the plate.

6 Claims, 13 Drawing Figures

PRESSING APPARATUS

Figure 1:
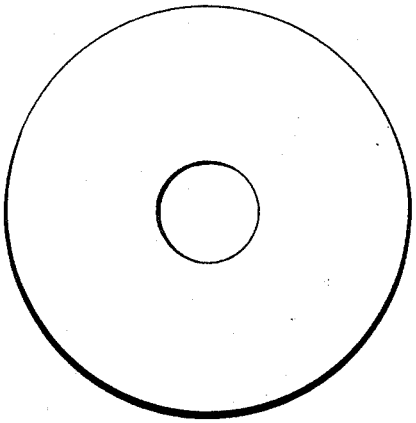

This invention relates to pressing apparatus and in particular to apparatus for distributing pressure over the area of a workpiece.

In the manufacture of sheet or sheet-like articles from materials such as plastics, a convenient method is to subject a workpiece of the material to pressure (and usually heat) in a press, usually of the hydraulic type. The workpiece is placed between plates having a polished or other suitable surface finish, hereinafter termed "press plates," thereby forming a "cell" and the plates are subjected to pressure between the platens of the press which are usually heated. In addition, relatively thick sheets of metal such as aluminum or mild steel, known as "caul plates," are often interposed between the platens and the press plates. This method suffers from the disadvantage, however, that variations in thickness of the platens, press plates, workpiece, and caul plates if used, cause uneven distribution of the pressure to the workpiece.

It has been common practice, especially when making pressed sheets from plastics materials, to attempt to alleviate these disadvantages by the incorporation of one or more layers of resilient material between the press platens and the press plates, or where caul plates are used, between the caul plates and the press plates.

Various systems have been proposed to provide this resilient layer but the system most generally used at present is one or more wads of several sheets of paper. The use of such a wad suffers from several disadvantages including a very limited useful life at high pressing temperatures necessitating very frequent renewal of the paper in the wad; handling difficulties, especially when automated loading of the press is desired; and, where it is necessary to heat and/or cool the workpiece during the pressing operation, poor thermal conductivity from the press platen to the press plates necessitating long press cycles.

The caul plates mentioned hereinbefore are used for two purposes. Firstly, they are used to prevent the wad(s) of paper sticking to the press platen(s). Some grades of paper do not stick, however, and in such cases the upper caul plate can be omitted. Secondly, the lower caul plate is used essentially to facilitate handling of the wad(s) of paper and the "cell" of press platens and workpiece, the cell and paper wad(s) being carried on the caul plate while being inserted into the press.

In U.S. Pat. No. 3,619,310, a method of overcoming the above mentioned problems is described, utilizing as the resilient layer a cushion plate consisting of a pair of continuous thin metal sheets spaced apart in substantially parallel manner and joined to each other round their periphery so as to form a flat resilient plate totally enclosing a chamber, said chamber being filled with a material that is liquid under the conditions of pressing.

In commonly assigned U.S. Pat. application Ser. No. 432,992, now abandoned, a pressure distributing device comprising a layer of a plurality of disc spring units was described. In one particular embodiment the disc springs were attached to a supporting plate by, e.g., countersunk rivets. I have devised a particularly satisfactory variation of that pressure distributing device which obviates the need for countersinking of the rivets.

According to the present invention I provide a pressure distributing device suitable for use as a resilient cushioning member in a press comprising a supporting plate and a plurality of disc spring units disposed adjacent to one another over the surface of the supporting plate, each disc-spring unit comprising a pair of disc springs disposed one on either side of the supporting plate with the apexes of the springs toward each other, the springs of each pair being fastened together by means of rivets passing through the orifices of the springs.

I also provide pressing apparatus, suitable for use in a method of making a pressed article by pressing a workpiece, comrising:

a. a press having at least two platens, b. a pair of press plates disposed between a pair of said press platens, and c. a pressure distributing device as defined above disposed between said press plates and one platen of said pair of platens.

Figure 2:
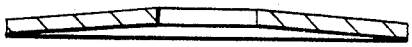
Figure 3:
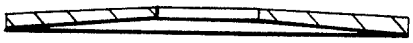
Figure 4:
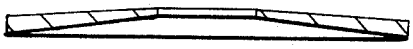
Figure 5:
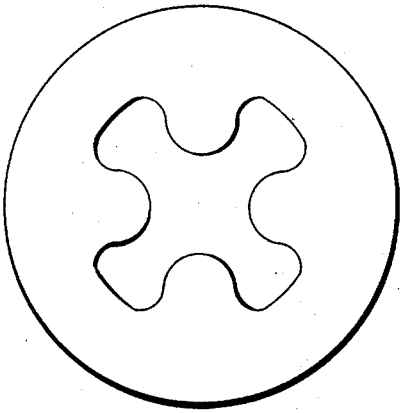
Figure 6:
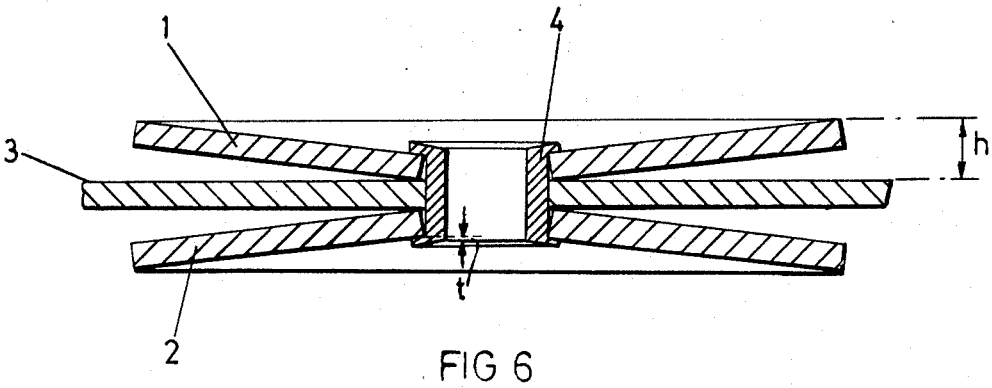
Figure 7:
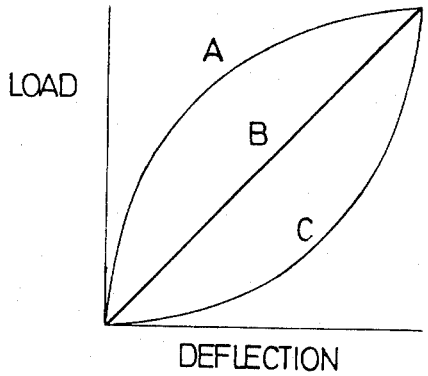
Figure 8:
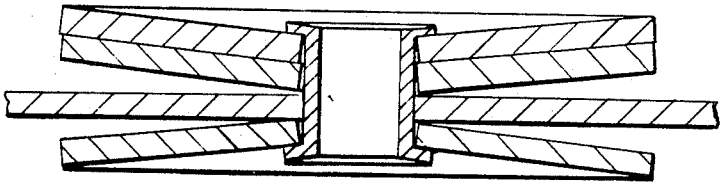
Figure 9:
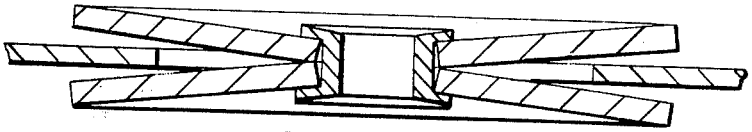
Figure 10:
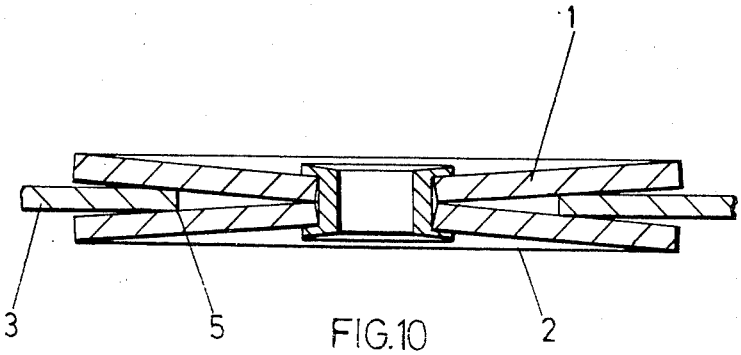
Figure 11:
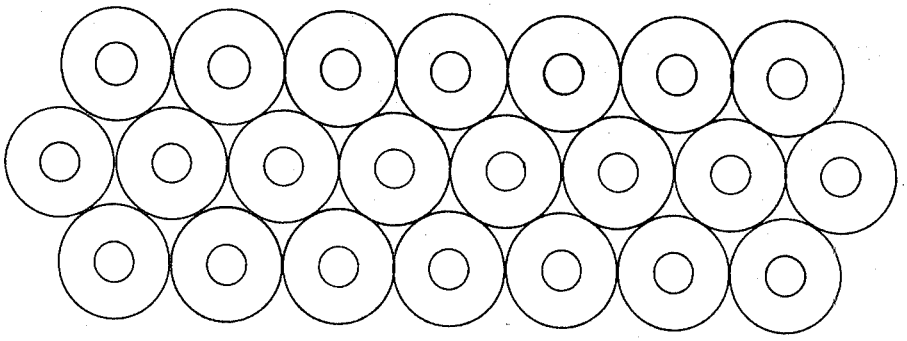
Figure 12:
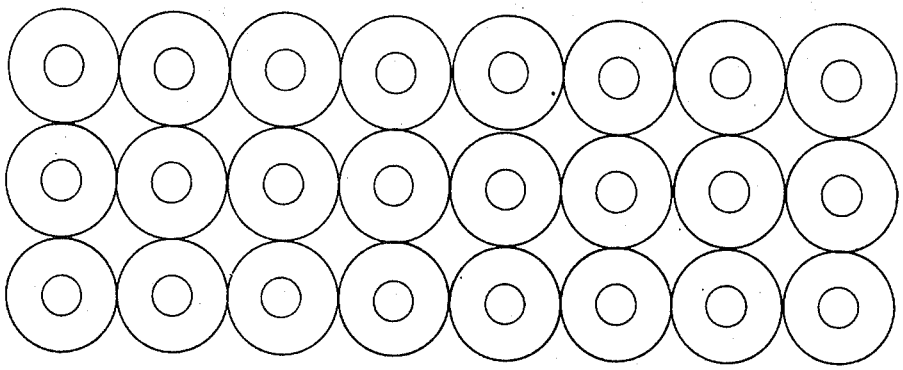
Figure 13:
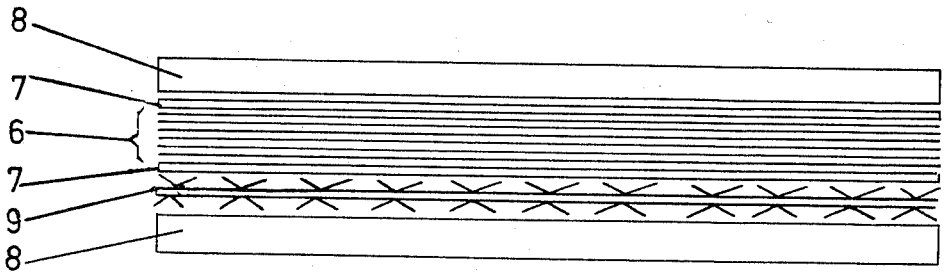

The invention is illustrated by reference to the accompanying drawings wherein:

FIG. 1 is a plan view of a disc spring,

FIGS. 2, 3 and 4 are cross-sections of alternative forms of disc spring, FIG. 5 is a plan view of an alternative form of disc spring, FIG. 6 and 8 are cross-sections of a preferred form of disc spring unit comprising two and three disc springs respectively, FIG. 7 is a graph showing the 'characteristics' of different disc spring units, FIGS. 9 and 10 are cross-sections of an alternative form of disc spring unit to that shown in FIG. 6, showing the unit before and after compression respectively, FIGS. 11 and 12 are plan views of part of alternative arrays of disc spring units, and FIG. 13 is a diagrammatic side elevation of a press assembly, with the elements thereof shown separated for clarity.

By the term "disc-spring" I mean a fursto-conical disc of metal having a central orifice and able to elastically absorb deformations caused by an outside load. Such disc-springs are readily available commercially in various sizes for use in shock absorbing devices and the type most commonly used is the radially straight frusto-conical disc having a rectangular cross-section and known as a belleville washer. This type of disc-spring, which is eminently suitable for use in the present invention, is shown in plan and in cross-section in FIGS. 1 and 2 respectively. Variants of this design are also very suitable, for example disc-springs having flattened contact surfaces (FIG. 3) or disc-springs of trapezoidal cross-section (FIG. 4). Disc-springs having a conical flowered or internally toothed apsect as shown in FIG. 5 may also be used and are also intended to fall within the scope of my definition. The types of disc-springs exemplified above are not intended to constitute an exhaustive list but illustrate the types of disc-springs suitable for use in my invention.

It is to be understood that the term "disc-spring" also includes springs which while not actually being disc-shaped can be thought of as being derived from a disc either notionally or in actuality by machining the perimeter of the disc so that it is no longer circular. For example, the perimeter could be polygonal rather than circular.

It has been proposed in British patent specification No. 708,070 to utilize disc-springs, such as belleville washers, in the construction of resilient cushions in presses. Here however, the construction was such that there was no provision for the accommodation of local variations in, e.g., platen or press plate thickness from one part of the platen or press plate to another.

In the present invention the pressure distributing device has an array of disc-springs disposed over both sides of a supporting plate. Hence local variations in thickness can be accommodated by compression of some disc-springs more than others.

In accordance with the present invention, a plurality of pairs of disc-springs are fastened to a supporting plate or sheet, with one spring of each pair on either side of the suppporting plate with its apex, i.e., the central orifice, adjacent the sheet by means of rivets (which are preferably eyelets) passing through orifices in the suppporting plate and through the central orifices of the springs. A typical form of construction is shown in FIG. 6 wherein numerals 1 and 2 indicate the disc-springs, 3 indicates the suppporting plate, and 4 indicates the rivet.

The utility of disc-spring pressure distributing devices of my invention may be more readily understood after a consideration of what is known as the 'characteristic' or 'character line' of a disc-spring, viz, the load versus elastic deflection curve resulting from the application of different loads uniformly round the inner and outer circumference of the disc-spring. The usual character line of a single conical disc-spring is curved and regressive as shown by line A of the graph shown in FIG. 7. Thus, as can be seen from curve A of FIG. 7, initial application of an applied pressure to such a single disc produces only a relatively small deflection (the initial part of the curve being steep compared with the upper part). However, as the disc-spring becomes flatter, subsequent equal increments of the pressure produce greater and greater deflection so that the character line becomes increasingly flattened up to the point corresponding to the flattened disc-spring. The curvature, i.e., the departure from linearity, of a regressive character line will increase with the ratio of the height of the disc (H) to its material thickness (M). Thus where H/M is very small, e.g., in the case of a very flat disc-spring and/or a disc-spring of very thick material, the character line will be almost straight (line B of FIG. 7).

The disc-springs are assembled one to the other in series, and, in some cases may be stacked in a combination of series and parallel (FIG. 8). The characteristic obtained for the disc-spring unit as a whole may differ from that of the individual springs and may in some cases allow a progressive characteristic to be obtained (line C of FIG. 7).

The utility of the present invention may now be exlained by considering a pressing operation using as an example a cell having two press plates with a workpiece sandwiched between them, the lower press plate being of uneven thickness (thinner at its perimeter than at its centre), and a disc-spring pressure distributing device in accordance with the present invention (having identical disc-spring units having a regressive character line) between the lower platen of the press and the uneven press plate, the area embraced by the array of disc-springs on the pressure distributing device, which area includes the spaces between the disc-springs and the central orifices, corresponding with that of the area of the uneven press plate. When the press closes the disc-springs opposite the centre of the platen will be compressed first, the compression being in accordance with the particular regressive character line of the disc-springs employed. With increasing applied pressure (as the press ram pressure builds up) the degree of compression of the central disc-springs will increase according to their character lines. The outer disc-springs will also be compressed (i.e., flattened) according to their characteristic. When the central disc-springs "arrive" on the upper part of their regressive curve the same increment of deflection will be obtained with a decreasingly smaller increment of pressure. At the same time, providing the disc-springs have a suitable load deflection characteristic to correspond with the irregularity of the press plate and the pressing pressure applied, the outer disc-springs will still be situated on the relatively steep part of their regressive character line. It can thus be seen that employing disc-springs of suitable characteristic will tend to equalize the pressure distribution applied to the workpiece on the other side of the press plate, because the pressure required to flatten the central disc-springs need be only slightly more than that required to compress the outer springs by a distance which is short of that of the central disc-springs by the thickness variation of the press plate. The same principle applies to the transmission of pressure through a press plate of any uneven thickness profile, and indeed to any other surface against which the disc-spring pressure distributing device directly or indirectly presses, e.g., that of a metal plate interposed between the platen and the press plate or that of the press platen itself or that of the workpiece.

This pressure equalizing effect is less pronounced with disc-springs having straight line characteristics although such springs may still be used.

Thus by a suitable choice of disc-springs, variations of pressure due to thickness variation or surface irregularity may be significantly reduced and a substantially constant pressure profile can be applied to a workpiece.

It is also apparent that by using disc-springs, or composite disc-spring units as shown in FIG. 8 of different characteristics to provide preselected parts of the disc-spring pressure distributing device, different pressures may be applied to the workpiece in a controlled and preselected manner. For example, it may be desirable to apply greater pressure to the edge region of the workpiece being pressed than to the central region, in which case the disc-spring units constituting a corresponding outer region of the pressure distributing device should be "harder" than the central disc-spring unitss, i.e., should require a greater pressure to compress them by the same distance than do the disc-spring units of the central part of the pressure distributing device. We prefer, however, to utilize a pressure distributing device in which all the disc-spring units are substantially identical.

It is thus seen that any desired pressure profile for application to the workpiece may be achieved by a suitable choice and suitable positioning of the disc-spring units.

Where the springs are used in parallel, as in FIG. 11, one or more (but not all) of the springs of the "parallel" spring unit may be of reduced size so as to strengthen only the central portion of the spring: such a structure is akin to a leaf spring.

In use the maximum pressure to which the pressure distributing medium of the invention can be subjected is limited by the characteristic of the disc-spring units. Thus the applied pressure should not exceed that which would cause the disc-springs to flatten to such an extent that the rivet projects from the supporting plate more than the outer edge of the disc-spring. If the pressure utilized was greater, marks or blemishes may be formed on the article being pressed at the rivet positions. Preferably the maximum applied pressure is such that the disc-spring does not deflect more than 80%, particularly not more than 75%, of its possible deflection.

The supporting plate (which is preferably of relatively thin flexible material, e.g., metal, for example of thickness 0.5 to 3 mm) with the attached disc-spring units, may be sandwiched between two metal sheets. These sheets serve to protect the disc-springs from damage and prevent the ingress of foreign matter.

The orifices in the supporting plate through which the locating members extend are preferably of similar size to those of the disc-springs. In such a case the apexes of the springs will contact either side of the supporting plate (as shown in FIGS. 6 and 8). However in some cases it is possible to employ a supporting plate with larger perforations. In this case the apexes of the disc-springs may contact each other rather than the plate (which thus only serves to position the spring pairs relative to one another). Such a construction is shown in FIG. 9. However, this construction is less preferred since the degree of possible deflection of the disc-springs may be reduced because of the possibility of engagement of the disc-springs 1 and 2 with the edge 5 of the perforation in the locating sheet 3 (as shown in FIG. 10) giving an irregular "characteristic" to the assembly.

The disc-spring units are disposed adjacent to one another (but not necessarily abutting) over the surface of the supporting plate. Preferably they are disposed in a regular array, e.g., as a plurality of columns each of which is composed of a line of a plurality of disc-spring units. The array is preferably of square or hexagonal units and the space between adjacent disc-springs is preferably less than the outer diameter of the disc-springs (i.e., the centres are less than two diameters apart).

Preferably the disc-spring units are spaced so that they nearly abut with one another. They should not be too closely spaced since then they will interfere with each other when flattened under pressure when their outside diameter will fractionally increase. Preferably they are spaced such that, when flattened, the array is close packed, e.g., hexagonal, close packed as in FIG. 11 or square close packed as in FIG. 12. There is, however, no reason why more space should not, in some cases, be left between the disc-spring units although this will, of course, increase the distance between the disc to surface contact points which may result in an unacceptable pressure drop in the region between the contacts.

The size (i.e., outer diameter) of the disc-springs to be used is not critical but should, of course, not be so large as to result in an unacceptable pressure drop in the surface region (against which the disc-springs abut during pressing) between adjacent disc-springs and, of course, should be small enough to be able to take account of changes in the irregularity of the surface against which they directly or indirectly abut during pressing. The size of the disc-springs that can be used will therefore be determined to some extent by the strength and rigidity and individual surface irregularity of the metal sheets, platen(s), and workpiece against which they directly or indirectly press during pressing. However, for practical purposes disc-springs having an outer diameter of 10 to 30 mm should suffice for most applications of my invention, particularly disc-springs within the range 12 to 19 mm.

The disc-springs used in the present invention may be made from any metallic material having a high tensile strength and a high elastic limit. The "hardness" of the disc-spring will be determined mainly by its internal and outer diameter and thickness and also by the actual material of which it is made. Suitable materials include any general spring steel such as chromium/vanadium steel, chromium/nickel steel, chromium/tungsten steel, chromium/molybdenum steel, unalloyed tool steel, chromium/molybdenum/vanadium steel, and also phosphor bronze. The choice of material to be used will depend, inter alia, on the particular character required for the desired pressing application and the temperatures to be employed during pressing.

It is usual in a pressing operation to heat the workpiece during pressing and for this reason the press platens are normally provided with means for heating them. For example the press platen may be drilled longitudinally to permit circulation of a heating fluid such as steam. In addition, it may also be desirable to cool the workpiece at the end of the pressing operation and so provision is usually made for circulating a cooling fluid through the press platens, e.g., using the same drilling through which steam may be circulated.

The disc-spring pressure distributing device of my invention may also be advantageous in that it will provide the most effective thermal conductivity from or to the heated or cooled platens through the press plates to the workpiece only when the press is exerting its full or a sufficiently high pressure such that many or more of the disc-spring units are flat and hence able to transfer heat over a wide surface area instead of through the rims of the disc-springs. In this way the thermal treatment of the workpiece may be more accurately controlled. If it is desired, however, to control the thermal treatment of the workpiece independently of the thermal conductivity through the disc-springs, then the whole system may be immersed in a heatable fluid of good heat transfer capability (e.g., ethylene glycol, water or mercury).

The disc-spring pressure distributing device may be positioned anywhere between the press-platens and the press plates. The choice of positioning may depend, e.g., on the particular surfaces(s) or plate(s) in the press whose irregularity or poor thickness tolerance is required to be compensated (e.g. the press platens, press plates or other interposed plates, or the workpiece itself — the pressure distributing device not necessarily directly abutting such a surface or plate but possibly being separated therefrom by one or more other interlayers) or, e.g., on the desired pressure profile to be delivered to the workpiece. The pressure distributing layer should be positioned with the disc-springs rather than the supporting plate, unless that is flexible, bearing against the irregular or uneven surface.

It is within the scope of my invention for more than one disc-spring distributing device to be utilized; for example one or more such devices may be positioned on each side of the cell being pressed.

More than one cell having a pair of press plates and a workpiece therebetween may be used in the press at the same time and one or more disc-spring pressure distributing device may, if desired, be positioned accordingly between each cell. Also, instead of using a cell having a pair of press plates and the workpiece, a cell having a plurality of workpieces separated from each other by a press plate or press plates may also be employed, particularly where each workpiece is thin. In such a case, the cell should have a pair of press plates as its outside layers.

Instead of using a press with just two platens, what is termed a multi-daylight press may also be used. This is a press, normally vertically operating, having a fixed platen, normally the uppermost one, and a platen acted upon by the ram, usually hydraulically operated. This 'driven' platen is normally the bottom platen. Between the fixed and driven platens there are mounted several intermediate 'free' platens slidably mounted on vertical guides provided with stops, or other means to limit the movement of the platens, so that when the press is open a number of spaces, termed "daylights," occur between each platen into which a cell consisting of a sandwich of the workpiece between the press plates, the disc-spring pressure distributing device and other metal plate(s), if used, are inserted. The fixed and driven platens generally have the same form as the intermediate platens. A typical commercial press may be equipped with a total of for example 11 platens giving 10 "daylights." Such presses are well known and are widely used in pressing, particularly laminating presses.

The method of the present invention is particularly suited to the manufacture of pressed sheets, particularly laminates of plastic materials, for example by the lamination of foils (which superimposed constitute the workpiece) of a thermoplastic polymeric material such as polyvinyl chloride or layers of absorbent material impregnated with a thermosetting resin. Our invention is also of use in the manufacture of laminates such as plywood or blockwood where, although the thickness tolerance required is not so critical, the press capacity can be increased by the use of thinner cells.

The present invention is further described and illustrated by reference to FIG. 13.

In FIG. 13, a workpiece comprising a pack of polyvinyl chloride foils 6 is shown sandwiched between press plates 7 themselves disposed between the platens 8 of a press. A disc-spring pressure distributing device 9 of the type shown in FIG. 6 is positioned between the lower press plate and its adjacent press platen.

The pressure distributing device had a length of about 31 cm and a width of 28 cm and was provided with 17 rows of pairs of disc-springs spaced equidistantly over a steel plate 3 of thickness 0.7 mm. The disc-springs, which had an outside diameter of 18 mm, an orifice of diameter 6.2 mm, and a height of 1.2 mm (dimension *h* in FIG. 6) were made of spring steel of 0.6 mm, and were spaced 19 mm between centres in a hexagonal array of 9 rows of 15 units and 8 rows of 16 units.

The washers were held in place by eyelet rivets passing through the central orifices of the disc-springs and the perforations in the steel supporting plate. The eyelets projected 0.18 mm beyond the surface of the washer — i.e., dimension *t* in FIG. 6.

The press was heated to 180°C and closed, and a pressure of about 7 kg $cm^{-2}$ was applied. The press was then cooled and the resulting laminated polyvinyl chloride sheet was found to have a good thickness tolerance.

In order to test the ruggedness and life of the pressure distributing device, it was placed between the platens of a press and a pressure of 12 kg $cm^{-2}$ was applied (this corresponds to a load per disc-spring pair of 39.6 kg). The thickness of the pressure distributing device decreased by 0.8 mm under the applied load. The pressure was then reduced and reapplied in a cyclic fashion 4 times a minute for a total of 230 cycles.

The above procedure was then repeated using an applied pressure of 14 kg $cm^{-2}$ (load per disc-spring pair of 46.3 kg) for a total of 100 cycles, and then repeated using an applied pressure of 16.6 kg $cm^{-2}$ (54.9 kg per disc-spring pair — this is 8 kg per disc-spring pair more than is necessary to flatten the disc-spring) for 25 cycles.

The pressure distributing device was then subjected to 2000 cycles at 11.7 kg $cm^{-2}$ applied pressure (38.7 kg per disc-spring pair) at 4 cycles per minute.

After all these pressing cycles no obvious damage had occurred to the eyelets and there was no permanent distortion of the assembly.

I claim:

1. A pressure distributing device comprising a supporting plate and a plurality of disc-spring units disposed adjacent to one another over the surface of the supporting plate, each disc spring unit comprising a pair of disc-springs disposed one on either side of the supporting plate with the apexes of the springs toward each other, the springs of each pair being fastened together by means of rivets passing through the orifices of the springs and through an orifice in the plate.

2. A pressure distributing device as claimed in claim 1 in which the rivets are eyelets.

3. A pressure distributing device as claimed in claim 1 in which the space between adjacent disc-spring units is less than the outer diameter of the disc-springs.

4. A pressure distributing device as claimed in claim 1 in which the disc-spring units are disposed on the supporting plate at such a distance apart that, when flattened, the disc-springs would be close packed.

5. A pressure distributing device as claimed in claim 1 in which the disc-springs have an outer diameter of 10 to 30 mm.

6. Pressing apparatus comprising:

a. a press having at least two press platens, b. a pair of press plates disposed between a pair of said press platens, and c. a pressure distributing device disposed between said press plates and one platen of said pair of platens, said pressure distributing device comprising a supporting plate and a plurality of disc-spring units disposed adjacent to one another over the surface of the supporting plate, each disc-spring unit comprising a pair of disc-springs disposed one on either side of the supporting plate with the apexes of the springs toward each other, the springs of each pair being fastened together by means of rivets passing through the orifices of the springs and through an orifice in the plate.

* * * * *